US010099897B2

(12) United States Patent
Mertala et al.

(10) Patent No.: US 10,099,897 B2
(45) Date of Patent: Oct. 16, 2018

(54) ELEVATOR HAVING A SAFETY CHAIN WITH A SERIES CONNECTION OF SAFETY SWITCH ARRANGEMENTS

(71) Applicant: KONE Corporation, Helsinki (FI)

(72) Inventors: Antti Mertala, Hyvinkää (FI); Ari Kattainen, Hyvinkää (FI); Claudio Donghi, Cesano Maderno (IT); Jouko Kinnari, Espoo (FI); Samu Salmelin, Helsinki (FI)

(73) Assignee: KONE CORPORATION, Helsinki (FI)

( * ) Notice: Subject to any disclaimer, the term of this patent is extended or adjusted under 35 U.S.C. 154(b) by 402 days.

(21) Appl. No.: 14/865,785

(22) Filed: Sep. 25, 2015

(65) Prior Publication Data

US 2016/0009526 A1 Jan. 14, 2016

Related U.S. Application Data

(63) Continuation of application No. PCT/EP2014/056790, filed on Apr. 4, 2014.

(30) Foreign Application Priority Data

Apr. 9, 2013 (EP) ..... 13162960

(51) Int. Cl.
*B66B 1/34* (2006.01)
*B66B 7/12* (2006.01)
(Continued)

(52) U.S. Cl.
CPC ..... *B66B 7/1223* (2013.01); *B66B 5/0025* (2013.01); *B66B 5/0031* (2013.01); *B66B 5/02* (2013.01); *B66B 13/22* (2013.01)

(58) Field of Classification Search
CPC ... B66B 7/1223; B66B 5/0025; B66B 5/0031; B66B 5/02; B66B 13/22
(Continued)

(56) References Cited

U.S. PATENT DOCUMENTS 4,568,909 A 2/1986 Whynacht
4,750,591 A * 6/1988 Coste ..... B66B 5/0006 187/391
(Continued)

FOREIGN PATENT DOCUMENTS

CN 101353125 A 1/2009
CN 102227367 A 10/2011
JP 2006-315794 A 11/2006

*Primary Examiner* — Anthony Salata
(74) *Attorney, Agent, or Firm* — Birch, Stewart, Kolasch & Birch, LLP

(57) ABSTRACT

An elevator has a safety controller to which several safety switch arrangements are connected. The safety controller is configured to cause the stop of the elevator motor and the activation of the motor brakes. A comparator is provided in the safety controller for the determination of the status of the safety chain. The comparator is connected with a memory for storing at least one resistor reference value, which comparator is configured to output a safety chain status signal in dependence of comparison of a measured resistance value with the resistor reference value. Each of said safety switch arrangements includes at least one first resistor and a safety switch which are connected in series. The value of the first resistor is different in at least some safety switch arrangements, preferably in all safety switch arrangements. Each safety switch arrangement includes at least a second resistor connected in parallel with the safety switch, which second resistor has a higher value than the first resistor. The detection of a short circuit as well as of the opening of a safety switch arrangement are allowed.

19 Claims, 1 Drawing Sheet

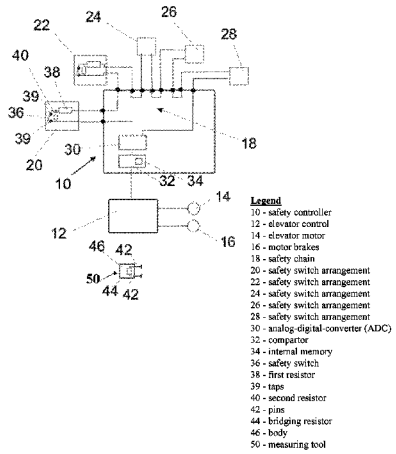

(51) Int. Cl.
*B66B 13/22* (2006.01)
*B66B 5/00* (2006.01)
*B66B 5/02* (2006.01)

(58) Field of Classification Search
USPC ..... 187/247, 316, 391, 393; 49/26, 28, 120
See application file for complete search history.

(56) References Cited

U.S. PATENT DOCUMENTS

| | | | | |
|---|---|---|---|---|
| 5,057,699 | A * | 10/1991 | Spence | G05B 19/0423 307/98 |
| 6,193,019 | B1 | 2/2001 | Sirigu et al. | |
| 7,264,090 | B2 * | 9/2007 | Vecchiotti | B66B 13/22 187/247 |
| 7,849,975 | B2 * | 12/2010 | Ketonen | B66B 13/22 187/316 |
| 7,891,467 | B2 * | 2/2011 | Kattainen | B66B 5/0056 187/316 |
| 7,980,363 | B2 | 7/2011 | Kattainen et al. | |
| 8,887,873 | B2 * | 11/2014 | Washio | B66B 5/0018 187/247 |
| 9,061,863 | B2 * | 6/2015 | Birrer | B66B 13/22 |
| 9,128,155 | B2 * | 9/2015 | Xing | B66B 5/0087 |
| 9,309,090 | B2 * | 4/2016 | De Coi | B66B 13/22 |
| 9,594,119 | B2 * | 3/2017 | Wiszniewski | H01H 9/167 |
| 2010/0051391 | A1 | 3/2010 | Jahkonen | |
| 2010/0141267 | A1 | 6/2010 | Quinn | |

* cited by examiner

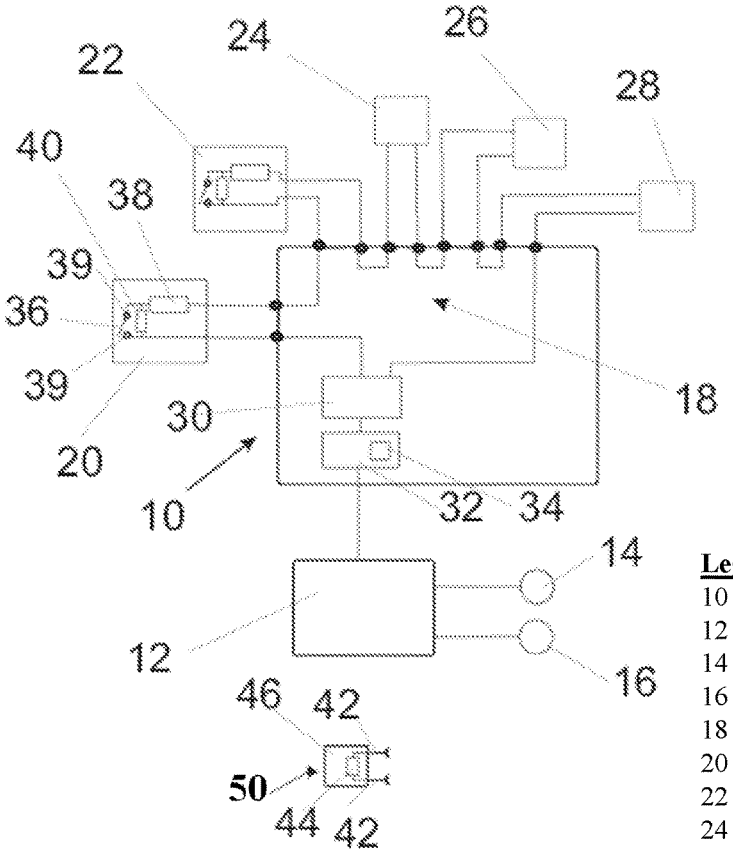

Legend

10 - safety controller
12 - elevator control
14 - elevator motor
16 - motor brakes
18 - safety chain
20 - safety switch arrangement
22 - safety switch arrangement
24 - safety switch arrangement
26 - safety switch arrangement
28 - safety switch arrangement
30 - analog-digital-converter (ADC)
32 - compartor
34 - internal memory
36 - safety switch
38 - first resistor
39 - taps
40 - second resistor
42 - pins
44 - bridging resistor
46 - body
50 - measuring tool

ELEVATOR HAVING A SAFETY CHAIN WITH A SERIES CONNECTION OF SAFETY SWITCH ARRANGEMENTS

CROSS REFERENCE TO RELATED APPLICATIONS

This application is a Continuation of PCT International Application No. PCT/EP2014/056790, filed on Apr. 4, 2014, which claims priority under 35 U.S.C. 119(a) to patent application Ser. No. 13/162,960.2, filed in Europe on Apr. 9, 2013, all of which are hereby expressly incorporated by reference into the present application.

BACKGROUND OF THE INVENTION

The present invention relates to an elevator having a safety controller to which several safety switch arrangements are connected. Usually the connections of the safety switch arrangements are connected to the safety controller as a safety chain with a series connection of the safety switch arrangements. Such safety chain is prescribed by common regulations as e.g. EN81-1. Different safety-related functions in an elevator, as e.g. the landing door closing function, the car door closing function, over-speed protection functions, etc. or control safety functions are provided with a corresponding safety switch arrangement whereby all the safety switch arrangements of the different safety functions are usually connected in series, although they might be connected directly to the safety controller at different ports. If any of these functions is not working according to regulations, e.g. if a landing door is still open, the safety switch of the safety switch arrangement is open and the safety controller to which the safety chain is connected gives an input to the elevator control to stop the elevator motor and to close the brakes (or to keep the in the locked state). The safety controller may also directly actuate the motor brake and disconnect the elevator motor.

As elevators are often operated over a very long time period, e.g. 30 years or more, the safety switch arrangements may become worn so that the connection or disconnection function of the safety switch arrangement does not work proper any longer. Therefore, it could happen that a safety switch arrangement has a short circuit in which case a corresponding landing door could stand open without the safety switch arrangement would indicate that status to the safety controller or interrupt the safety chain. The U.S. Pat. No. 7,980,363 discloses a safety arrangement where the safety switch arrangements comprise a resistor which is connected parallel to the safety switch of the corresponding safety switch arrangement. This solution reveals information about the number of open switches by measuring the resulting resistance value of the safety chain.

The US 2010/051391 discloses a method according to the present invention.

BRIEF SUMMARY OF THE INVENTION

It is object of the present invention to provide an elevator according to the above-mentioned type with an improved safety.

The object is solved with an elevator according to the present invention. Preferred embodiments of the invention are subject-matter of the dependent claims.

Some inventive embodiments are also discussed in the description and drawings of the present application. The inventive content may also consist of several separate inventions, especially if the invention is considered in the light of expressions or implicit subtasks or from the point of view of advantages or category of advantages achieved. In this case, some of the attributes contained in the claims below may be superfluous from the point of view of separate inventive concepts. The features of the various embodiments can be applied within the scope of the basic inventive concept in conjunction with other embodiments.

The elevator of the invention has a safety controller to which several safety switch arrangements are connected. Often, but not necessarily this connection is performed via a series connection of the safety switch arrangements in a safety chain which is connected to the safety controller. The safety controller is configured to initiate the stop of the elevator motor and the activation of the motor brakes if one of the safety switch arrangements is open, or to keep the elevator stopped and the brake engaged. This is to ensure that an elevator cannot start moving with open doors. According to the invention at least one, preferably all safety switch arrangements comprise at least one first resistor connected in series with the safety switch. The safety controller comprises a comparator for the determination of the status of the safety chain. The comparator is connected with or has a memory for storing at least one resistor reference value. The comparator is configured to output a safety chain status signal in dependence of the result of a comparison of a measured resistance value with the resistor reference value. Accordingly, the proper function of the safety switch arrangement (a closed safety switch position) can be detected by a quite low resistance of the safety switch arrangement.

If the safety switch arrangements are connected in series in a safety chain then normally the resulting resistance value in the safety chain corresponds to the addition of the first resistor values in the safety chain. A short circuit of one of the safety switch arrangement can easily be detected by a drop of the resulting resistance value of the safety chain by the value of one first resistor because of the approximately zero resistance of the short circuited safety switch arrangement. Accordingly, the invention enables the differentiation between a short circuit of the safety switch arrangement and the proper function when the safety switch is closed.

Preferably the first resistor is directly connected to the safety switch in the safety switch arrangement. This ensures that the status of the safety switch arrangement (short circuited or closed or open) can accurately defined for each safety switch arrangement.

If the safety switch arrangements are connected in series in a safety chain the connection of the safety switch arrangements to the safety controller is simplified as not each safety switch arrangement has to be connected to the safety controller.

Particularly in this case it is advantageous if the value of the first resistor in the different safety switch arrangements is different. This enables the safety controller to determine which of the safety switch arrangements has a short circuit. In this connection it is to be mentioned that a short circuit sometimes takes place in the wiring to and from the corresponding safety switch arrangement. Also in this case the safety controller can detect to which safety switch arrangement this short circuit is allocated.

For the determination of the status of the safety switch arrangements the safety controller comprises a comparator. The comparator is provided or connected with a memory for at least one resistor reference value. The comparator is configured to output a safety chain status signal in dependence of the comparison of the measured resistance value of the safety switch arrangements, e.g. the resulting resistance value of the safety chain with the resistor reference value(s).

A proper function of the safety switch arrangements e.g. in the safety chain is supposed when the resulting resistance value of the safety chain corresponds to the series connection of the first resistors of the safety switch arrangements within certain tolerances.

If e.g. the measured resulting resistance value of the safety chain exceeds said sum of the first resistor values of the safety switch arrangements by a first threshold value, then the safety chain is deemed interrupted, the brake is (kept) activated and the elevator motor is (kept) stopped. Accordingly, the elevator according to the present invention can clearly distinguish between the proper function of all safety switch arrangements in the safety chain and an interruption of the safety chain.

If on the other hand a safety switch arrangement is short circuited, the measured resulting resistance value of the safety chain drops below the sum of the first resistors of the safety switch arrangements in the safety chain. If the drop exceeds a second threshold value a short circuit of a safety chain arrangement is supposed which leads to the same precaution measures as mentioned above, i.e. the elevator motor is (kept) stopped and the motor brake is (kept) engaged by de-energizing the motor brakes.

Accordingly, in the invention, a specified range of resistor values is deemed as proper function of the safety chain. If the value is too low, this is interpreted as a short circuit of at least one safety switch arrangement and if the value is too high, this is interpreted as an interruption of the safety chain.

According to the invention, the safety chain status therefore can be checked more accurate and a short circuit of a safety switch arrangement can easily be detected and used to stop the elevator.

The short circuit detection of course also works if each safety switch arrangement is connected to the safety controller by its own port.

Preferably at least one, preferably each safety switch arrangement, comprises at least a second resistor connected in parallel with the safety switch, which second resistor has an essentially higher value than the first resistor. Via this this measure also for the opening of the safety chain a defined resistance value is provided. Therefore, the safety controller is able to check whether the safety switch of a safety switch arrangement has opened (which leads to a resistance increase by the second resistor value) of if the corresponding safety switch arrangement is disconnected (e.g. because of a wiring connection problem or a wiring break).

According to a further preferred embodiment of the invention the values of the second resistor are different in the various safety switch arrangements. Thus, if the safety switch of a safety switch arrangement is open, it can be read directly from the measured resulting resistance value in the safety chain which of the safety switch arrangements is/are open.

Accordingly, this measure provides a more detailed safety function of the safety chain including the corresponding safety controller.

Preferably, the value of the first resistor is different in the different safety switch arrangements. By this measure, it is possible to get information about which safety switch arrangement is short circuited. Accordingly, a signal can be transmitted to a remote maintenance location as to replace a corresponding safety switch arrangement.

If a first and second resistor according to the above-mentioned type is provided, these are preferably connected in series so that if the safety switch is closed, the resistance value of the safety switch arrangement is the value of the first resistor and when the safety switch is opened, the resulting resistance value of the safety switch arrangement is the sum of the values of the first and second resistor. By this measure, the different status of proper function, short circuit and opening of the safety switch arrangement can easily be detected.

Preferably, the safety controller comprises an analogue-digital-converter (ADC) to transform the analogue resistance value of the safety chain into a digital value which is then processed in a digital processing part of the safety controller. The digital processing of the signals, particularly in the comparator of the safety controller has several advantages as the data handling in the elevator control generally is based on digital data transfer and digital data processing.

Normally, the safety controller is a part of the elevator control. Usually, the safety controller is integrated with the elevator control, but can also be placed at a separate location. The safety controller can be configured to directly activate the brakes and stop the motor but can also have a connection to the elevator control to perform the stopping of the motor and the closing of the motor brake via the elevator control.

In a preferred embodiment of the invention, a measuring tool is provided having a bridging resistor for the safety switch of a safety switch arrangement whereby the value of the bridging resistor is in a range which is evaluated in the comparator of the safety controller as proper value that doesn't require the activation of the motor brake and the deactivation of the motor. The value is therefore preferably higher than the value of the first resistor but lower than the value of the second resistor, if present. With this measure it is possible to verify whether the safety switch itself has a short circuit or not. In case the safety switch itself has a short circuit, the resulting resistance of the safety switch arrangement when the measuring tool is bridging the safety switch is the resistor value of the first resistor. If the safety switch works properly, the opening of the safety switch will lead to a resulting resistance value of the safety switch arrangement of the first resistor plus the value of the bridging resistor of the measuring tool (as these are connected in series). This can easily be detected by the safety controller. Accordingly, such measuring tool can be used to check the proper function of each safety switch of the safety switch arrangement. Preferably, the contactors on both sides of the safety switch of each safety switch arrangement are connected with measuring taps for the measuring tool.

The first resistor may have a value e.g. between 50 Ω and 500Ω. The second resistor, if provided, may have a value between 500 Ω and 10Ω and the bridging resistor of the measuring tool may have a resistance value of 200 Ω to 1 kΩ.

Provided the first resistor has a value of 100 ohm and the bridging resistor of the measuring tool has a value of 500 ohm, this would lead to following truth table for the comparator:

| Measured resistance | Diagnostic status | Safety status |
|---|---|---|
| 0-50 Ω | short circuit | stop |
| 50-200 Ω | ok | running |
| 400-600 Ω | intended bypass by maintenance tool | running with conditions |
| >700 Ω < 2 kΩ | ok | running |
| >2 kΩ | open safety chain | „ stop |

The generation of a safety status is provided by the comparator which compares the measured resistance with reference values. In the above case the reference values defining the allowable status are 50 Ω and 2 kΩ.

According to the truth table, the elevator detects a short circuit as well as an interruption of the safety chain by an open safety switch as well as a use of a bridging resistor of a measuring tool (status: running with conditions). Accordingly, the invention provides a very sophisticated safety controller for deriving more accurate and more detailed information about the safety status of the elevator.

The invention also relates to a method for checking the safety status of an elevator using a safety chain with a series connection of safety switch arrangements. Each safety switch arrangement comprises a series connection of a safety switch with the at least one first resistor. The resulting resistance value of the complete safety chain is measured. In the measurement at least one safety switch arrangement is assumed to be short circuited if the measured resulting resistance value falls below the sum of the first resistor values of the safety switch arrangements in the safety chain by a first threshold value. At least one safety switch arrangement is assumed as being open if the measured resulting resistance value exceeds the sum of the first resistance values in the safety chain by a second threshold value. Accordingly, by the invention it could easily be detected whether the safety chain is closed and works properly or whether there is a short circuit in a safety chain arrangement or whether at least one safety switch arrangement is open. The information obtained by the inventive method therefore exceeds the information which is obtained by usual safety chains comprising a series of safety switches connected in series.

In a preferred embodiment of the inventive method, short circuits in a safety switch arrangement is measured with a bridging resistor which is connected in parallel to the safety switch of a safety switch arrangement which bridging resistor has a value lower than the second threshold value.

If the bridging resistor which may be part of a measuring tool is connected in parallel to the safety switch and the safety switch is opened, this should lead to a change of the resulting resistance value. If no change happens, the safety switch of the measured safety switch arrangement is short circuited. If, on the other hand, the safety switch works properly, the value of the resulting resistance value increases by the value of the bridging resistor. As the value of the bridging resistor is lower than the second threshold value, this will be measured so that it is apparent that the safety switch works properly, but, on the other hand, the elevator motor is not stopped and the brakes are not activated (de-energized) as the raise of the resistance value is below the second threshold value. Accordingly, by this method, the functions of the single safety switches can be easily measured without activating the safety controller so as to stop the elevator and activate the brakes.

Preferably different values for the first resistor are used in the different safety switch arrangements as this allows the location of a short circuited safety switch arrangement.

The invention is now described by an example in connection with the appended drawing.

BRIEF DESCRIPTION OF THE DRAWING

FIG. 1 shows a schematic diagram of the safety relevant parts of an elevator.

DETAILED DESCRIPTION OF THE INVENTION

The FIG. 1 shows a safety controller 10 connected to an elevator control 12 which is in functional connection with an elevator motor 14 as well as the motor brakes 16. The safety controller 10 comprises a safety chain 18 with a series connection of five safety switch arrangements 20, 22, 24, 26, 28. The safety chain 18 is connected to an analog-digital-converter (ADC) 30 which is connected to a comparator 32 having an internal memory 34.

The FIGURE also shows a measuring tool 50 which is explained in detail hereinafter. Each of the safety switch arrangements 20-28 consists of a safety switch 36 connected in series with a first resistor 38. In the safety switch arrangement 20, 22, 24, 26, 28, furthermore, a second resistor 40 is connected in parallel to the safety switch 36, but in series to the first resistor 38. On both sides of the safety switch are taps 39 which can be connected to pins 42 of the measuring tool. These pins 42 are connected by a bridging resistor 44. This measuring tool 50 further comprises a body 46 to which the pins 42 and the bridging resistor 44 are mounted. during the measurement of the safety switch 36 of a safety switch arrangement 20, 22, 24, 26, 28 the pins 42 of the measuring tool 50 are connected to the tabs 39 thereof. In this connection, it has to be mentioned that the construction of each safety switch arrangement is identical to that shown in connection with safety switch arrangement 20. These safety switch arrangements are arranged in the elevator at different locations as e.g. landing door contacts, car door contacts, shaft pit working arrangement, over-speed protection, etc.

The function of the inventive safety controller is as follows: In normal operation, all safety switches are closed which enables the elevator motor to work and the motor brakes to open. In this status the resulting resistance value of the safety chain 18 is the sum of the values of the first resistor of each safety switch arrangement 20, 22, 24, 26, 28. When the elevator car stops at a floor and the car door and landing door are open, two of said safety switch arrangements are open which initiates the safety controller to issue a signal to the elevator control 12 to keep the motor 14 stopped and to keep the brakes 16 in grip. This status check is performed via an ADC which provides the resulting resistance value of the safety chain 18 as a digital value to the digital comparator 32. The comparator 32 compares the resulting resistance value with reference values stored in the internal memory 34. In this connection, it has to be carried out that the memory can also be placed at a different location, e.g. somewhere at the safety controller 10 or within the elevator control 12. For the derivation of the status signal by the comparator, two threshold values are defined. A first threshold value is provided if the resulting resistance value is lower than the sum of the first resistance values. If said first threshold value is exceeded, one of the safety switch arrangements 20-28 is deemed short circuited. This means that for the corresponding safety switch arrangement a zero value is measured instead of the first resistance value. This leads to a reduction of the measured resulting resistance value by the value of one first resistor. Accordingly, the first threshold value has to be a little bit lower than the first resistor value to reliably indicate a short circuit.

If, on the other hand, a safety switch 36 is open, then the comparator 32 measures for said safety switch arrangement the series connection of the first resistor 38 and the second resistor 40. The second resistor 40 which is connected in parallel to the safety switch has preferably a value which is essentially higher than that of the first resistor 38. For example, the first resistor 38 may have a value of about 100Ω, whereas the second resistor 40 may have a value of about 1 kΩ.

For a proper detection of an open safety switch, the second threshold value should therefore be lower than the second resistor value, i.e. lower than 1 kΩ in this example.

Accordingly, the inventive safety controller is able to provide a proper signalling of a short circuit status as well as an open switch status of a safety switch arrangement.

The bridging resistor 44 of the measuring tool 50 has a value lower than the second resistor value, e.g. 500Ω. If the function of the safety switches in the safety switch arrangements are measured, the pins 42 are connected to the taps 39 of each safety switch arrangement and the safety switch 36 is opened. In case of a proper opening function, the resulting resistance value should increase by the value of the bridging resistor, in the present case 500Ω. This increase of the resistor value indicates the proper function of the safety switch. If the resistance value is unchanged then the safety switch is short circuited. In this case the elevator has to be put out of use and the short circuited safety switch arrangement should be replaced.

It shall be clear for the skilled person that the number of safety switch arrangements connected to the safety controller 10 is dependent on the size and the components of the elevator. It is further clear for the skilled person that the safety controller 10 may be an integral part of the elevator control 12 or that the safety controller 10 may directly activate the brake 16 and stop the elevator motor 14. The safety switch arrangements 20 to 28 could also be connected to the safety controller otherwise than via a series connection, e.g. via separate ports.

The invention may be varied within the scope of the appended patent claims.

The invention claimed is:

1. An elevator, comprising:

a safety controller to which several safety switch arrangements are connected, which safety controller is configured to cause the stop of the elevator motor and the activation of the motor brakes; and a comparator provided in the safety controller for the determination of the status of the safety chain, which comparator is connected with a memory for storing at least one resistor reference value, which comparator is configured to output a safety chain status signal in dependence of comparison of a measured resistance value with the resistor reference value, wherein each of said safety switch arrangements comprises at least one first resistor and a safety switch which are connected in series, wherein the value of the first resistor is different in at least some safety switch arrangements, and wherein each safety switch arrangement comprises at least a second resistor connected in parallel with the safety switch, which second resistor has a higher value than the first resistor, wherein a measuring tool includes a bridging resistor connected to pins, wherein the pins are connected with taps on both sides of one of said safety switches.

2. The elevator according to claim 1, wherein the safety controller is connected to a safety chain comprising a series connection of the safety switch arrangements.

3. The elevator according to claim 1, wherein the comparator is connected to the safety chain via an analogue digital converter.

4. The elevator according to claim 1, wherein the at least one resistor reference value is an allowed range of resistor values for the safety chain.

5. The elevator according to claim 1, wherein the second resistor is connected in series with the first resistor.

6. The elevator according to claim 1, wherein the stored reference value comprises a lower reference value and a higher reference value.

7. The elevator according to claim 1, wherein the bridging resistor is electrically connected to the comparator to indicate an allowed safety chain status.

8. The elevator according to claim 1, wherein the safety controller is part of the elevator control.

9. The elevator according to claim 1, wherein the first resistor is directly connected to the safety switch of the safety switch arrangement.

10. A method for checking the safety status of an elevator using a safety chain with a series connection of safety switch arrangements, wherein each safety switch arrangement comprises a series connection of a safety switch with at least a first resistor, in which method the resulting resistance value of the complete safety chain is measured and a second resistor connected in parallel with the safety switch, wherein at least one safety switch arrangement in the safety chain is assumed to be short circuited if the measured resulting resistance value is by a first threshold value below the sum of the values of the first resistors in the safety chain, wherein at least one safety switch arrangement in the safety chain is assumed as being open if the resulting resistance value is by a second threshold value above the sum of the first resistor values in the safety chain, wherein different values of the first resistors are used in the safety switch arrangements, wherein by measuring, via a measuring tool, the resulting resistance value of the safety chain, it is determined which of the safety switch arrangements is short circuited, wherein a short circuit is measured by bridging the safety switch of a safety switch arrangement with a bridging resistor of the measuring tool having a value lower than the second threshold value, and wherein the bridging resistor is connected to pins, wherein the pins are connected with taps on both sides of one of said safety switches.

11. The elevator according to claim 1, wherein the value of the first resistor is different in all safety switch arrangements.

12. The elevator according to claim 2, wherein the comparator is connected to the safety chain via an analogue digital converter.

13. The elevator according to claim 2, wherein the at least one resistor reference value is an allowed range of resistor values for the safety chain.

14. The elevator according to claim 3, wherein the at least one resistor reference value is an allowed range of resistor values for the safety chain.

15. The elevator according to claim 2, wherein the second resistor is connected in series with the first resistor.

16. The elevator according to claim 3, wherein the second resistor is connected in series with the first resistor.

17. The elevator according to claim 4, wherein the second resistor is connected in series with the first resistor.

18. The elevator according to claim 2, wherein the stored reference value comprises a lower reference value and a higher reference value.

19. The elevator according to claim 3, wherein the stored reference value comprises a lower reference value and a higher reference value.

* * * * *